US012723825B2

(12) United States Patent
Benoit et al.

(10) Patent No.: US 12,723,825 B2
(45) Date of Patent: Sep. 1, 2026

(54) HEAT EXCHANGE BLOCK, METHOD FOR MANUFACTURING SAME, HEAT EXCHANGER EQUIPPED WITH SUCH A BLOCK AND METHOD FOR IMPLEMENTING SAME

(71) Applicant: MERSEN FRANCE PY SAS, Pagny-sur-Moselle (FR)

(72) Inventors: Jérémie Benoit, Pont a Mousson (FR); Matthieu Bories, Montigny les Metz (FR); Guillaume Brun, Metz (FR)

(73) Assignee: MERSEN FRANCE PY SAS, Pagny-sur-Moselle (FR)

( * ) Notice: Subject to any disclaimer, the term of this patent is extended or adjusted under 35 U.S.C. 154(b) by 180 days.

(21) Appl. No.: 18/569,753

(22) PCT Filed: Jun. 7, 2022

(86) PCT No.: PCT/IB2022/055277
§ 371 (c)(1),
(2) Date: Dec. 13, 2023

(87) PCT Pub. No.: WO2022/263972
PCT Pub. Date: Dec. 22, 2022

(65) Prior Publication Data

US 2025/0012520 A1 Jan. 9, 2025

(30) Foreign Application Priority Data

Jun. 14, 2021 (EP) ..... 21179189
May 5, 2022 (EP) ..... 22171766

(51) Int. Cl.
*F28F 7/02* (2006.01)
*F28D 7/00* (2006.01)
*F28F 21/02* (2006.01)

(52) U.S. Cl.
CPC ..... *F28F 7/02* (2013.01); *F28D 7/0008* (2013.01); *F28F 21/02* (2013.01)

(58) Field of Classification Search
CPC ..... F28F 7/02; F28F 21/02; F28D 7/0008
See application file for complete search history.

(56) References Cited

U.S. PATENT DOCUMENTS 1,571,068 A * 1/1926 Stancliffe ..... F28F 9/26 165/165
2,821,369 A 1/1958 Hilliard
(Continued)

FOREIGN PATENT DOCUMENTS

EP 0744587 A1 * 11/1996 ..... F28F 7/02
GB 1078868 8/1967
WO 2006/081965 10/2006

OTHER PUBLICATIONS

International Search Report for Application No. PCT/IB2022/055277, Mailed on Aug. 29, 2022.

*Primary Examiner* — Jianying C Atkisson
*Assistant Examiner* — For K Ling
(74) *Attorney, Agent, or Firm* — Jordan IP Law, LLC; Todd A. Vaughn

(57) ABSTRACT

This heat exchange block (1) comprises a body (10), longitudinal channels (20) intended to the flow of a process fluid, and transverse channels (60), intended to the flow of a service fluid. According to the invention at least one front face (2), in particular upstream front face delimits a central bowl (3) defining a central surface (S3), a peripheral seat (4) defining a peripheral reference surface (S4) and a transition portion (5), the distance (h4) between peripheral surface (S4) and closest transverse channel (60*a*) being substantially superior to distance (h3) between central surface (S3) and closest transverse channel (60*a*). The thermal stress generated on the block of the invention is far lower than in prior (Continued)

art, so that lifetime of both block and heat exchanger is much longer than in prior art.

18 Claims, 9 Drawing Sheets

(56) References Cited

U.S. PATENT DOCUMENTS

| | | | | |
|---|---|---|---|---|
| 2,887,303 | A * | 5/1959 | Reys | F28D 7/163 165/DIG. 56 |
| 3,250,322 | A * | 5/1966 | Mccrary, Jr. | C04B 41/87 165/164 |
| 3,315,739 | A * | 4/1967 | Kearney | F28F 21/02 165/DIG. 396 |
| 3,391,016 | A | 7/1968 | McCrary et al. | |
| 4,044,825 | A * | 8/1977 | Gugenberger | F28F 21/02 165/DIG. 396 |
| 2005/0056410 | A1* | 3/2005 | Ishiyama | F28F 7/02 165/165 |
| 2016/0146549 | A1* | 5/2016 | Schneweis | B61D 1/04 165/185 |
| 2018/0058774 | A1* | 3/2018 | Perez-Torres | F28F 9/005 |

* cited by examiner

HEAT EXCHANGE BLOCK, METHOD FOR MANUFACTURING SAME, HEAT EXCHANGER EQUIPPED WITH SUCH A BLOCK AND METHOD FOR IMPLEMENTING SAME

CROSS-REFERENCE TO RELATED APPLICATIONS

The present application is a National Stage Application of PCT International Application No. PCT/IB2022/055277 (filed on Jun. 7, 2022), under 35 U.S.C. § 371, which claims priority to European Patent Application Nos. EP 21179189.2 (filed on Jun. 14, 2021) and EP 22171766.3 (filed on May 5, 2022), which are each hereby incorporated by reference in their respective entireties.

TECHNICAL FIELD OF THE INVENTION

The invention relates to the technical field of block heat exchangers. It relates more particularly to a heat exchange block, which is provided with an improved geometry with regards to both thermal and mechanical issues. The invention also relates to an exchanger which is equipped with such a heat exchange block.

PRIOR ART

Numerous types of heat exchangers are known, of which mention shall be made inter alia of plate, tube or fin exchangers. The invention relates more particularly to a block type heat exchanger. The latter typically comprises first an inlet and an outlet for a so-called process fluid, both provided along main axis of the exchanger. Moreover the casing of this exchanger is equipped with transverse inlet and outlet, both for a so-called service fluid. Process fluid is for example an acid while service fluid is a heat transfer fluid, such as water.

The casing accommodates at least one heat exchange block, typically a plurality of these blocks which are stacked on top on one another. Each block is made of a thermally conductive material. The present invention more specifically relates to process fluids which are corrosive to metals. In this respect, said material is typically graphite optionally associated with additives, for example of the polymer type. This block may be parallelepipedic or cylindrical, bearing in mind that the invention more specifically aims cylindrical shaped blocks.

Two series of channels, intended for the circulation of respectively process fluid and service fluid, are hollowed in said block. The first channels, which are longitudinal, continuously extend between the front faces of the body and open onto said front faces. Moreover the second channels, which are transverse, continuously extend between the opposite transverse faces of the body and open onto said transverse faces.

Block heat exchangers of the above known type are described for example in EP-A-0 196 548 and WO-A-2006/081965.

Block heat exchangers of the prior art, such as above disclosed, are however not satisfactory, in particular with regard to mechanical issues. Indeed, some material failures have been observed, which reduce the lifetime of the exchanger. These failures occur in particular at the outer periphery of the front face of the block, which is upstream with reference to the flow of hot process fluid.

U.S. Pat. No. 3,391,016 describes a process for manufacturing a heat exchange element, which is formed by an annular body of graphite. U.S. Pat. No. 2,821,369 discloses a heat exchanger comprising a plurality of hollow cylindrical blocks of graphite, which are arranged in axial alignment to form a column having a central hollow interior. These two documents deal with heat exchange blocks, the type of which is substantially different from that aimed by the invention. Indeed, due to the annular shape of the blocks, the transverse channels do not continuously extend between the transverse faces of the block.

Finally GB-A-1 078 868 discloses a heat exchanger equipped with several graphite blocks, but which is not provided with an external casing. Each of said blocks is formed by two distinct parts, which are mutually fixed by clamping. This further document is not concerned with a heat exchange block of the type according to the invention, since this block does not include longitudinal and transverse channels. Indeed, in this British document, the process fluid and the service fluid flow into two series of channels which both open onto the front faces of the block. That being said, one aim of the present invention is providing a heat exchange block which makes it possible to remedy the drawbacks, inherent to above-mentioned prior art.

A further aim of the present invention is providing such a block which ensures both satisfactory mechanical and thermal performances to the heat exchanger equipped therewith.

A further aim of the present invention is providing such a heat exchanger, which has a relatively simple structure and which can be manufactured without any particular risk of mechanical rupture, particularly with respect to the channels hollowed in the blocks belonging to this exchanger.

OBJECTS OF THE INVENTION

One object of the present invention is a heat exchange block (1; 501; 1001, 2001, 3001) comprising:

- a body (10), said body being in particular made of graphite, said body having in particular a cylindrical shape, with a circular cross-section
- first so-called longitudinal channels (20), formed in this body along a longitudinal direction (L1) of the block, each longitudinal channel continuously extending between two opposite front faces (2, 6; 502, 506; 1002, 1006, 2002, 2006, 3002, 3006) of the body, while opening onto said front faces, said longitudinal channels being intended to the flow of a first so-called process fluid,
- second so-called transverse channels (60; 560), formed in this body along a transverse direction, each transverse channel continuously extending between two opposite transverse faces (7, 8) of the body, while opening onto said transverse faces, said transverse channels being intended to the flow of a second so-called service fluid, characterized in that at least one front face (2; 502; 1002, 1006, 2002, 2006, 3002, 3006), is provided with a recess (22; 522) so that said front face delimits:

- a central so-called homogenization bowl (3; 503; 1003, 1103, 2003, 2103, 3003, 3103), intended to homogenize the temperature of the constitutive material of the block, said bowl defining a so-called central reference surface (S3; S503)
- a peripheral seat (4; 504) adapted to receive sealing means, said seat protruding upstream with respect to said central bowl along the longitudinal direction, said seat defining a so-called peripheral reference surface (S4; S504)

a transition portion (5; 505) which extends between said peripheral seat and said central bowl, the so-called peripheral distance (h4; h504) between peripheral surface (S4; S504) and a so-called facing wall (61; 561) of the closest transverse channel (60*a*; 560*a*) being substantially superior to the so-called central distance (h3; h503) between central surface (S3; S503) and said wall (61; 561) of closest transverse channel (60*a*), said distances (h3; h503) and (h4; h504) being considered along longitudinal direction of the block.

According to advantageous features of the heat exchange block according to the invention:

ratio (h4/h3) between said peripheral distance and said central distance is superior to 1.2, preferably to 2.

peripheral distance (h4) is superior to d60*a*, in particular to 2*d60*a*, wherein d60*a* is the diameter of said closest transverse channel (60*a*).

central distance (h3) is superior to t26, preferably to 2*t26, wherein t26 is the smallest material thickness between said longitudinal channels (20) and said transverse channels (60).

so-called transition angle (a5) between reference surface (S5) of transition portion and reference surface (S3) of bowl is between 30° and 90°.

only said upstream front face (2; 502) is provided with said bowl (3; 503), whereas opposite downstream front face (6; 506) is substantially flush or is provided with a fluid distribution chamber, the depth (D903) of this chamber being far inferior to the depth (D3/D503) of the bowl.

both upstream front face and downstream front face are provided with respective bowls (1003, 1103, 2003, 2103, 3003, 3103).

One further object of the present invention is a manufacturing method of a heat exchanger block as defined above, said method comprising:

providing a preform, in particular a standard heat exchanger block, said preform comprising a body, first so-called longitudinal channels, formed in this body along a longitudinal direction of the preform, which open onto two opposite front faces of the preform, said front faces being both substantially flush, second so-called transverse channels, formed in this body along a transverse direction, which open onto two opposite transverse faces of the preform, removing material of the preform, in particular by machining or any analogous process, so as to form said bowl (3) and said transition portion (5).

One further object of the present invention is a heat exchanger (I; II; III) comprising an enclosure having a lower cover (310; 1310), an upper cover (320; 1320) and a peripheral casing (330; 1330), at least one heat exchange block (1, 101, 201; 501; 1001, 2001, 3001) arranged between the lower cover and the upper cover, each block comprising:

a body, first so-called longitudinal channels, formed in this body along a longitudinal direction of the block, which open onto two opposite front faces of the body, said longitudinal channels being intended to the flow of a first so-called process fluid, second so-called transverse channels, formed in this body along a transverse direction, which open onto two opposite transverse faces of the body, said transverse channels being intended to the flow of a second so-called service fluid, the exchanger further comprising first inlet means (322; 1332) of a first fluid into the first channels second inlet means (336; 1336) of the second fluid into the second channels first outlet means (312; 1312) of the first fluid from the first channels second outlet means (337; 837; 1337) of the second fluid from the second channels said exchanger being characterized in that at least one heat exchange block (1; 501; 1001, 2001, 3001) is a heat exchange block as defined above.

According to advantageous features of the heat exchanger according to the invention:

said exchanger comprises one single heat exchange block (1; 501) as defined above, said single block being a so called upstream block located closest to first inlet means (322), said single block (1; 501) being provided with one single bowl (3; 503) located on the so called upstream front face (2; 502) turned towards said first inlet means.

distance (d561) considered along longitudinal direction of the block, between said facing wall (561) of said closest transverse channel (560*a*) and the upper wall (838) of said second outlet means (837) of second fluid is inferior to 20 mm, in particular to 10 mm, said wall (561) of said closest transverse channel (560*a*) being advantageously closest to the first inlet means, than upper wall (838).

several and, preferably, all heat exchange blocks are heat exchange blocks (1001, 2001, 3001) as defined above.

One further object of the present invention is a method for the implementation of a heat exchanger as defined above, wherein the first and second fluids are circulated in the first and second channels, so as to enable the heat exchange thereof, first fluid flowing through the exchanger under a monophasic form, without significant condensation in case said first fluid is a gas, said first fluid being in particular admitted in the first inlet means at a temperature superior to 80° C., whereas second fluid is in particular admitted in the second inlet means at a temperature between −20° C. and +35° C.

According to a feature of the invention, said first fluid may be admitted into first inlet means at a temperature superior to 200° C.

Still one further object of the present invention is a method for the implementation of a heat exchanger as defined above, wherein the first and second fluids are circulated in the first and second channels, so as to enable the heat exchange thereof, wherein first fluid is submitted to a condensation through the exchanger, the inlet temperature of first fluid being in particular between +80° C. and +300° C. whereas its outlet temperature is in particular between −15° C. and +60° C., the inlet temperature of second fluid being in particular between −20° C. and +35° C., whereas its outlet temperature is in particular between −15° C. and +45° C.

DESCRIPTION OF THE FIGURES

The invention will be described hereinafter, with reference to the appended drawings, given by way of non-limiting example, wherein.

DETAILED DESCRIPTION OF THE INVENTION

Figure 1:
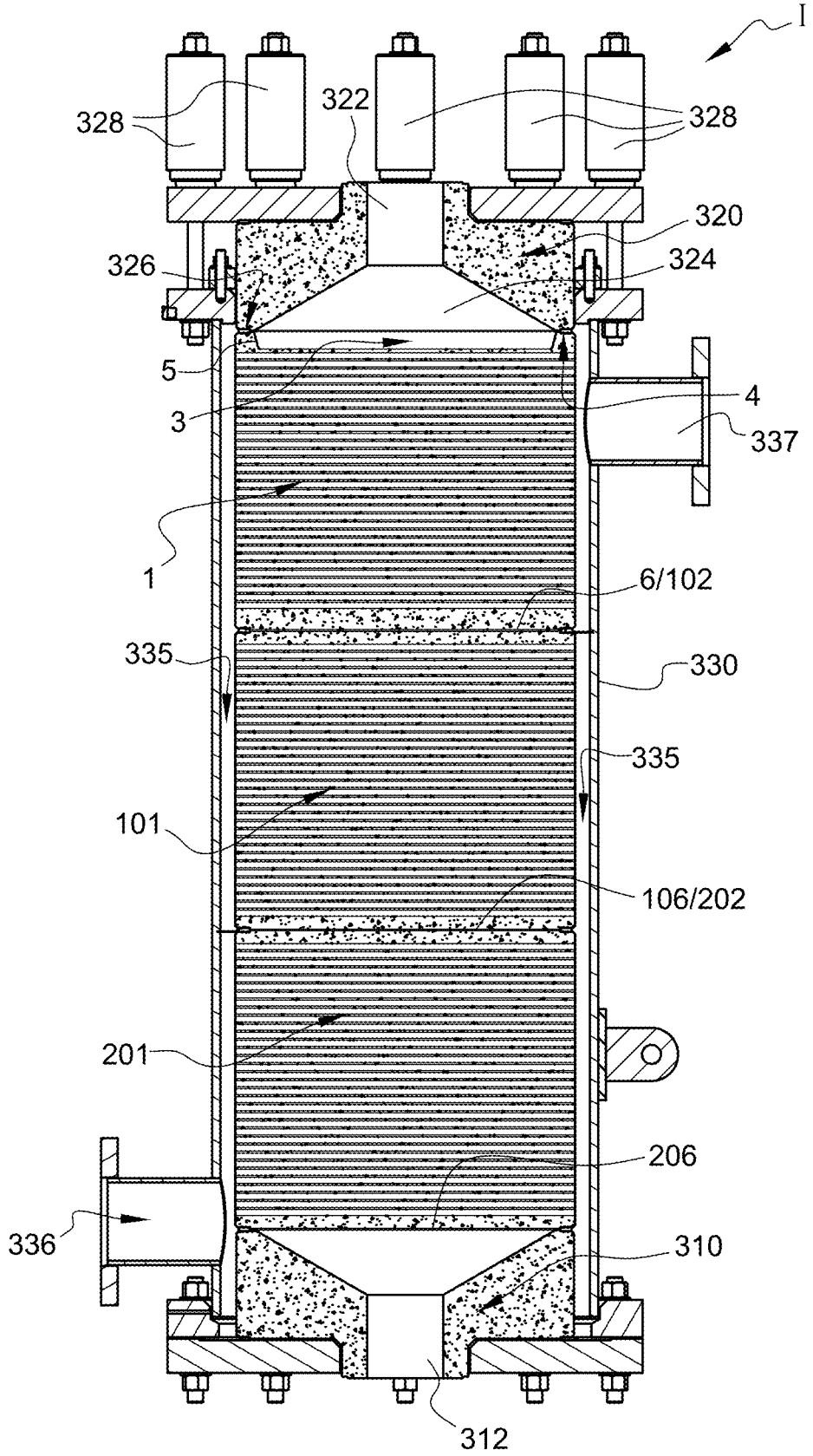
FIG. 1 is a longitudinal sectional view, illustrating a heat exchanger which is equipped with a block according to a first embodiment of the invention.

The following reference numbers will be used throughout the present description

I heat exchanger according to first embodiment of the invention
1 upstream block according to the invention
10 body of block 1-12 baffles on 10
L1 longitudinal direction of the block
2 upstream front face of block 1
C P center and periphery of 2-20 longitudinal channels
22 recess in face 2-3 central bowl of face 2
h3 distance between S3 and 61-4 seat of face 2
h4 distance between S4 and 61-41 shoulder
5 transition portion between bowl 3 and seat 4
S3, S4 and S5 reference surfaces of 3, 4 and 5
a5 angle between S3 and S5
6 downstream front face of block 1
7, 8 upstream, downstream face of transverse channels
60 transverse channels
t26 thickness of material between 20 and 60
d60 diameter of 60-60*a* upstream transverse channels
d60*a* diameter of channel 60*a*-61 wall of 60*a*
60*b*-60*e*: channels immediately under channel 60*a*
DZ dead zone
101 201 blocks of exchanger I, according to prior art
102 202 upstream faces of blocks 101 201
106 206 downstream faces of blocks 101 201
310 lower cover of exchanger I-312 opening in 310
320 upper cover of exchanger I-322 opening in 320
324 space in 320-326 collar
328 springs-330 casing of exchanger I
335 peripheral chamber-336 337 inlet and outlet pipes
IV exchanger according to prior art
401 upstream block-402 front face of 401
h402 distance between 402 and 460*a*
C', P' center, periphery of 402-460 transverse channels
h460 distance between two channels 460
460*a* upstream transverse channel-420 cover
R rest zone of 420
II heat exchanger according to second embodiment of the invention
501 and following: same as 1 and following added by 500 apart from
838 wall of our client pipe 837
d561 distance between wall 561 and 838
903/D903 distribution chamber and its depth (FIG. 11)
III heat exchanger according to third embodiment of the invention
1001 and following: same as 1 and following added by 1000 apart from
1103 second bowl of block 1001
2001 second block according to the invention
2003, 2103 opposite bowls of block 2001
3001 third block according to the invention
3003, 3103 opposite bowls of block 3001

FIG. 1 illustrates a heat exchanger according to a first embodiment of the invention, which is referenced I as a whole. This exchanger firstly comprises a plurality of heat exchange blocks 1, 101 and 201. As will be described below in further detail, block 1 is according to the invention whereas blocks 101 and 201 are conform to prior art. In the example, three blocks stacked on top of one another have been represented, it being understood that a different number of blocks may be envisaged. Preferably, whatever the number of blocks, only one single block according to the invention is provided.

Figure 2:
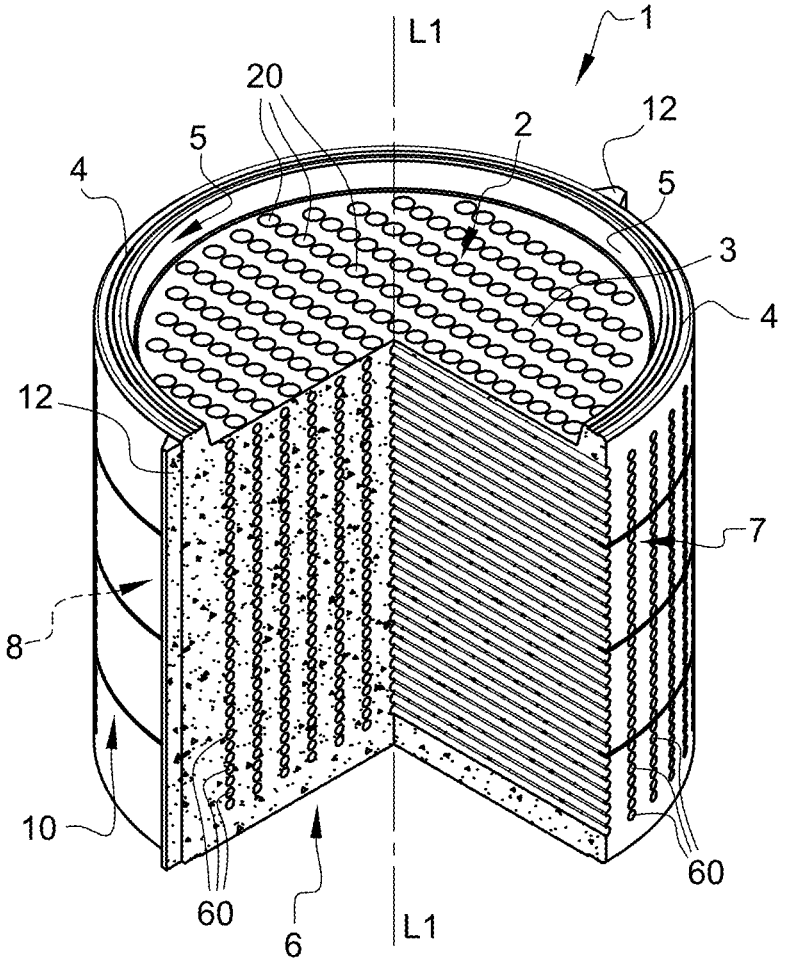
FIG. 2 is a perspective view with cutaways, illustrating a block according to the invention.
Figure 5:
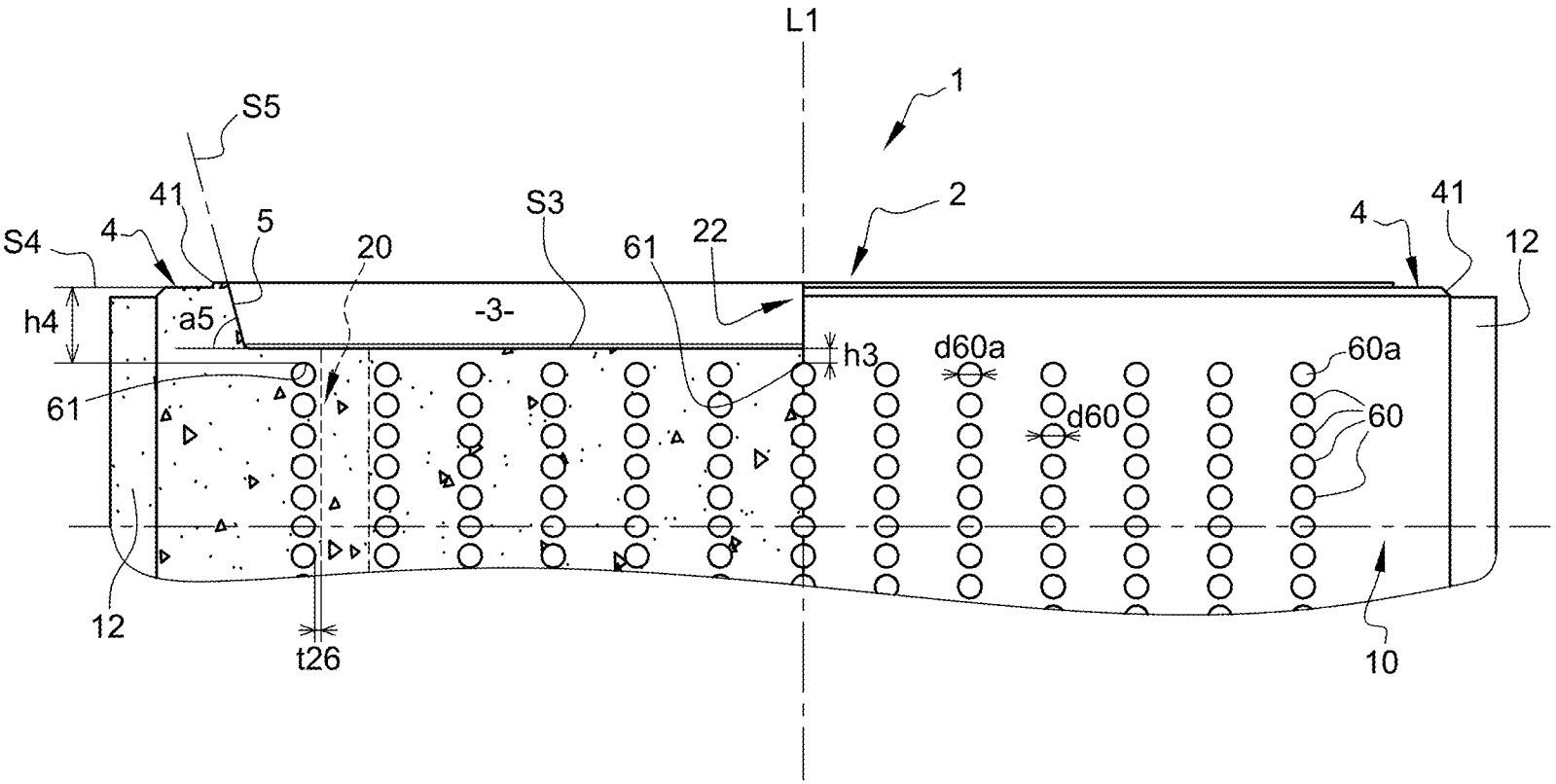
FIG. 5 is a longitudinal sectional view, showing at still a greater scale the upstream extremity of the block of FIG. 3.

These different blocks 1, 101 and 201 are made of any suitable material, in particular adapted to a corrosive environment, such as for example graphite. Each block has a body, which is referenced 10 for what concerns block 1. Said body has a typical cylindrical shape, with a circular cross-section. In a way known as such baffles 12, which are illustrated in particular on FIG. 2 as well as on FIG. 5, are provided at the outer periphery of this body 10.

L1 refers to the main or longitudinal axis of each block, which is parallel with the main axis of the exchanger. In a manner known per se, each block is hollowed with different channels, so as to permit the flow of two fluids intended to be placed in mutual heat exchange.

A first series of channels 20, parallel with the axis L1 and referred to as longitudinal channels, open onto the opposite front faces 2 and 6 of each block. With reference to the flow direction of the fluid along longitudinal channels, each front face 2 is called upstream and each opposite front face 6 is called downstream.

Moreover, a second series of transverse channels 60, extending obliquely, particularly perpendicular to the axis L1, open onto the opposite transverse faces 7 and 8 of each block. In operation two fluids, circulating respectively in the first and second series of channels, are placed in heat exchange. These channels 20 and 60 are distant from one another, that is to say they do not open into one another.

Apart from blocks 1 to 201, heat exchanger I also comprises a lower cover 310, an upper cover 320, as well as a peripheral casing 330. Upper cover 320 is hollowed with an opening 322 intended for the inlet of a first so-called process fluid into the longitudinal channels of all three blocks. This inlet is connected with a source of this fluid, which is situated upstream and is not illustrated. Said opening leads to a space 324, provided in the lower face of the cover.

Moreover, the lower cover 310 is hollowed with an opening 312 intended for the outlet of the first fluid outside the longitudinal channels. This outlet is connected with an appropriate downstream equipment, such as a piping. The latter, which is known as such, is not illustrated on the figures.

Casing 330 defines, with the opposite walls of the blocks, a peripheral bowl 335 intended for the circulation of a second so-called service fluid, intended to be placed in heat exchange with the process fluid in the blocks 1 to 201. For this purpose, the casing is equipped with respective inlet 336 and outlet 337 pipes of this second fluid, connected with another appropriate downstream equipment, such as a further piping. The latter, which is also known as such, is not illustrated on the figures.

Above-mentioned space 324 delimits a peripheral collar 326 which rests upon the upstream block 1, in use. So as to avoid any contact between the two fluids, it is critical to ensure a tight seal between the conducting walls of the block 1 and the collar 326. To this end, the interface between said block and said collar is equipped with sealing means, which are known as such and are not illustrated in detail. Moreover upper cover 320 is provided with pressing means, adapted to exert a controlled compressive force on the block, as well as on said sealing means. In the illustrated example, these pressing means are formed by springs 328, in a way known as such In the present example, downstream front face 6 of upstream block 1, as well as both front faces 102, 106, 202 and 206 of other blocks 101, 201 are manufactured according to prior art. In other embodiments, in particular the one of FIGS. 12 to 14, both front faces may be provided with a respective chamber as will be detailed hereafter.

Turning back to FIG. 1, the general structure of said classic faces is known per se and will not be explained here. It is sufficient to explain that these front faces 6, 102, 106, 202 and 206 are substantially flush. The word «flush» means that said front face is globally formed at the same altitude, with reference to main longitudinal axis of the block. In this respect each front face may be either completely flush or hollowed with at least one groove, the depth thereof is low, which is suitable for forming the seat of a sealing member, for example of the O-ring type.

Upstream front face 2 of upstream block 1 is on the contrary manufactured according to the invention. Indeed it is not flush but is however provided with a central recess 22, the depth thereof is substantial, thus delimiting:

- a central bowl 3, which leads to space 324 provided in the cover;
- a peripheral seat 4, radially surrounding said bowl; and
- a transition portion 5, which extends between said peripheral seat and said central bowl.

In the present embodiment, said central bowl 3 is flush and defines a so-called central reference surface S3. As an alternative, this bowl may not be flush, for example may have a corrugated shape. In this event, said reference surface is defined by the average altitude of said bowl.

Said seat 4 protrudes upstream with respect to said central bowl 3 along the longitudinal direction L1. It defines a so-called peripheral reference surface S4 which is flush in the present embodiment. In some variants this seat is not flush, but is provided for example with grooves adapted to receive some seals. Surface S4 is then defined by the average altitude of the seat, the same way as above mentioned surface S3. In use, collar 326 of upper cover 320 rests upon seat 4, while exerting compressing action on this seat due to the springs 328.

It is to be noted that, in the present example, a shoulder 41 is provided at the radial inner end of seat 4. This shoulder, the function of which is typically to maintain an annular seal, exerts no mechanical action.

Transition portion 5 is rectilinear in the present example, when viewed in cross-section on FIG. 5. By way of an alternatives, this portion may have other shapes with the provision for example of steps. Portion 5 is associated with a transition surface S which is defined the same way as surfaces S3 and S4.

Let us define some essential representative dimensions of upstream front face 2 of block 1:

- so-called peripheral distance h4 between peripheral surface S4 and the wall 61 of the closest transverse channel 60*a*, along longitudinal direction of the block. Said wall 61 is called "upper" with reference to its position on the figures, but also "facing" since it is turned towards the process fluid inlet.
- so-called central distance h3 between central surface S3 and said wall 61 of closest transverse channel, along longitudinal direction of the block.

According to an essential feature of the invention, which will be detailed below, said distance h4 is far superior to said distance h3. In this respect, it shall be underlined that the applicant has identified explanations with respect to the drawbacks of prior art, as well as the importance of said essential feature.

Figure 4:
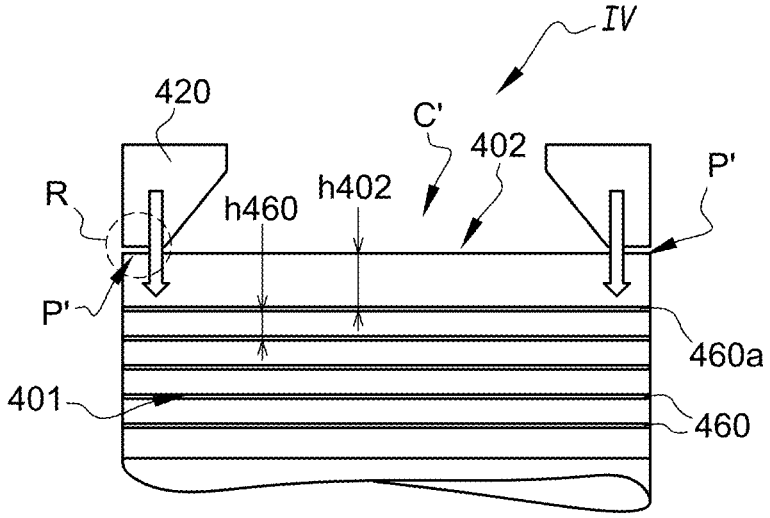
Fig. 4 PRIOR ART
FIG. 4 is a longitudinal sectional view, analogous to FIG. 3, illustrating the upstream extremity of a block according to prior art, as well as of a heat exchanger equipped with such a block.

Let us refer now to FIG. 4, illustrating an exchanger IV according to prior art. On this FIG. 4 mechanical elements which are analogous to those of exchanger I are given the same references, added by number 400.

Let us firstly note R the so-called rest zone where the upper cover 420 rests upon the upstream graphite block 401. In this zone a minimum clamping force has to be applied, which induces a noticeable compressive stress on the area of the graphite column, where the cover 420 is bearing. The compressive load on the rest zone R leads to tensile stresses close to the maximum allowable tensile stress. This problem is compounded by the presence of the upstream transverse channels 460*a* passing under the surface supporting the cover.

To ensure mechanical performance heat exchangers according to prior art are provided with a substantial thickness of material, which forms a flush front face 402. In other words, as shown on said FIG. 4, distance h402 separating said front face 2 and the upstream transverse channels 460*a* is far higher than the distance h460 between two adjacent series of transverse channels. This makes it possible to reduce the stress supported by the graphite material in the area of the first layer of horizontal channels.

Even though this design is theoretically advantageous as far as mechanical matter are concerned, it however creates an undesired thermal-stress issue. The latter, which is illustrated on FIG. 4, is especially severe when the process fluid is introduced in the heat exchanger at a high temperature.

In the center C' of front face 402 the graphite surface is firstly in contact with the hot incoming process fluid. Moreover it is far away from the first cooling channel, due to the high value of h402. In periphery P' of this front face, the graphite surface is also in contact with the hot incoming process fluid. However, contrary to center C', this periphery P' is also quite close from the service fluid, the temperature of which is far inferior to that of process fluid.

As a consequence temperature $T_{C'}$ in the center is far superior to temperature $T_{P'}$ in the periphery. As a result the volume of graphite in the vicinity of the center expands more than the volume of graphite in the vicinity of the periphery, which induces the development of a thermal stress across the heat exchanger. This stress is likely to cause some material failure, especially in the periphery area P'.

The latter is indeed submitted to a combination of a mechanical stress due to clamping force, as well as of a thermal stress due to thermal gradient through the graphite block. This failure phenomenon is likely to occur especially in transient modes, when the heat exchanger starts receiving some hot process fluid, after being idle for a time long enough to have an even and low temperature. As a summary the applicant has identified that, even though upstream end of prior art exchange blocks are provided with a substantial thickness of material, it paradoxically leads to mechanical fragility.

Figure 6:
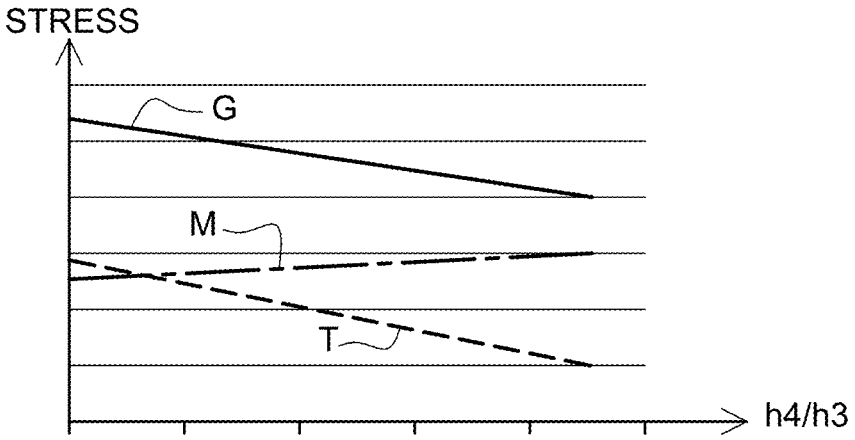
FIG. 6 is a graph, showing the evolution of both thermal and mechanical stresses of the block of the invention, according to the value of a representative ratio of this block.

As mentioned above one essential feature of the invention is to significantly increase ratio h4/h3. In this respect FIG. 6 illustrates the variations of both mechanical and thermal stresses, with respect to ratio h4/h3. On the graph of FIG. 6, x-axis corresponds to said ratio. Moreover chain-dotted lines illustrate the variation of a parameter M which is representative of mechanical stress of the block, dotted lines illustrate the variation of parameter T which is representative of thermal stress of the block, whereas solid lines illustrate the global stress G, i.e. the sum of M and T stress values. Both for M and T, the lower the value, the better is the behaviour.

As shown by this FIG. 6, thermal stress decreases as ratio h4/h3 increases. Moreover mechanical stress increases as said ratio h4/h3 increases. However, in a surprising manner, the decrease of thermal stress is far more significant than the increase of mechanical stress. As a result, the value of the global stress G tends to decrease due to the increase of ratio h4/h3.

In theory this increase of ratio h4/h3 can be achieved, either by increasing the value of h4 and/or by reducing the value of h3. In practice it is preferred to keep h4 at a value, which is similar to that of prior art blocks. In this respect, h4 is advantageously set so that the stress applied by the clamping force, through the upper cover, is compatible with the material mechanical properties. Due to the specific geometry of the front face 2 of the block, the clamping force is mostly carried by the annular seat 4, as well as subsidiary by the transition portion 5.

On the other hand, h3 is significantly reduced so as to reach values that are far inferior to prior art. In other words the central portion of the front face is rendered much thinner than the periphery of the block. Moreover, in a surprising way, this reduction of h3 is not prejudicial to the global mechanical behavior. This makes it possible to lower by far thermal stress, with respect to prior blocks with flush front face such as illustrated on FIG. 4. Therefore h3 can be advantageously set at a very low value, without any regards for mechanical stresses imposed by the clamping force. This low value favors an efficient thermal exchange between the top surface of bowl 3 and the underlying layer of horizontal channels 60*a*, as they are close from each other.

Figure 3:
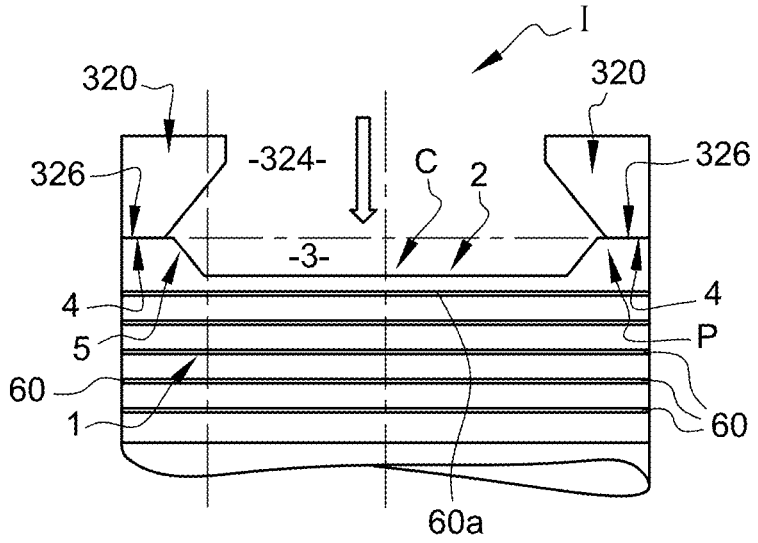
FIG. 3 is a longitudinal sectional view, similar to FIG. 1, illustrating in more detail the upstream extremity of the block of FIG. 2, as well as of the exchanger of FIG. 1.

When compared to the prior art, there is an improved thermal exchange between the column top surface in contact with the hot process fluid and the first layer of channels in contact with the cold service fluid. As a consequence the center portion C of the front face 2, as illustrated on FIG. 3, has in use a lower temperature than the center portion C' of prior art, illustrated on FIG. 4. The thermal gradient $T_P$-$T_C$, according to the invention, is therefore significantly reduced with respect to prior art gradient $T_{P'}$-$T_{C'}$.

As a consequence, the thermal stress generated by this thermal gradient is far lower than in prior art, so that lifetime of both block 1 and heat exchanger according to the invention is much longer than in prior art. This reduction of blocks breakages leads to a decrease of the global volume of impregnated graphite to be manufactured. In addition, less wastes of such impregnated graphite are to be handled. These advantages will be illustrated by the comparative example, recited at the end of the present description.

As a summary, the invention takes the side to remove graphite material in a targeted zone. This makes it possible to improve thermal performances, due to this local thinning, while preserving high mechanical performances. Therefore, in a surprising way, removing material is not prejudicial to global mechanical behaviour.

Turning back to graph of FIG. 6, those skilled in the art will be in a position to choose an appropriate value of ratio h4/h3, so as to obtain a significant decrease of global stress G and, therefore, to substantially improve the global behavior of the block and of the whole exchanger.

This improvement is due to a technical effect of temperature homogenization throughout the block, the magnitude of which increases with the value of above ratio h4/h3. Let us call threshold ratio, the ratio above which this technical effect becomes significant. According to the general scope of the invention, this threshold ratio h4/h3 is advantageously superior to 1.2, preferably superior to 2.

Moreover those skilled in the art will choose this ratio, so as to preserve the global mechanical strength of the block as well as of the exchanger. In this respect said ratio h4/h3 is advantageously inferior to 50, preferably inferior to 15.

In an advantageous way, with reference in particular to FIG. 5:

- h4 is superior to d60*a*, preferably to 2*d60*a*, wherein d60*a* is the diameter of channels 60*a*. In this respect, h4 is superior for example to 8 mm (millimeters).
- h4 is inferior to 10*d60*a*, preferably to 5*d60*a*. In this respect, h4 is inferior for example to 100 mm, in particular to 50 mm.
- h3 is superior to t26, preferably to 2*t26, wherein t26 is the material thickness between channels 20 and 60. On this FIG. 5, the walls of one channel 20 are schematically shown in dotted lines. In this respect, h3 is superior for example to 1 mm.
- h3 is inferior to 0.8*h4, preferably to 0.4*h4. In this respect, h3 is inferior for example to 20 mm.

Turning back to FIG. 5, let us note a5 the angle between reference surface S5 of portion 5 and surface S3. Typically said angle a5 is between 3° and 90°. In the illustrated example, said portion is rectilinear. However, said portion 5 may be differently shaped, in particular stepped. In this case, reference surface is a line passing through bottom point and top point of said portion 5.

Block 1 may be manufactured starting from a standard block according to prior art, opposite front faces of which are substantially flush. In this respect, recess 22 is provided in one single of these front faces. This stage may be carried out typically by a machining process. Once said recess has been provided, this leads to the formation of both central bowl 3 and transition portion 5. Typically no material is removed in the periphery of said standard block, at the level of seat 4. Such a manufacturing method is advantageous, since it makes it possible to revamp a classic heat exchange block.

In view of the use of the above heat exchanger I, process fluid and service fluid are admitted in a way known as such, via inlets 322 and 336. Exchanger I is more specifically adapted for a so-called cooling operation, which corresponds to a substantially monophasic flow of process fluid. In this respect, said process fluid may be a liquid or, in case it is a gas, it does not undergo any significant condensation.

In a typical way, admission temperature of process fluid is superior to 80° C. As it will be detailed hereafter, the invention also encompasses the possibility of bowls, which are deeper than the one 3 of the present embodiment. With that in mind, block 1 and exchanger I are more particularly dedicated to treat a process fluid with an admission temperature inferior to 200° C. In this range of temperatures, the specific geometry of this first embodiment is advantageous with regard to prior art designs, for what concerns thermal issues. Moreover, due to its relatively shallow bowl, the manufacturing of the block is convenient.

On the other hand, admission temperature of service fluid is typically between −20° C. and +35° C. Once these two fluids have been admitted in the exchanger, they are placed in heat exchange in a usual way. Cooled process fluid is discharged via the outlet opening 312, at a typical temperature between −15° C. and +60° C., whereas warmed up service fluid is discharged via the outlet tube 337 at a typical temperature between −15° C. and +45° C.

Figure 7:
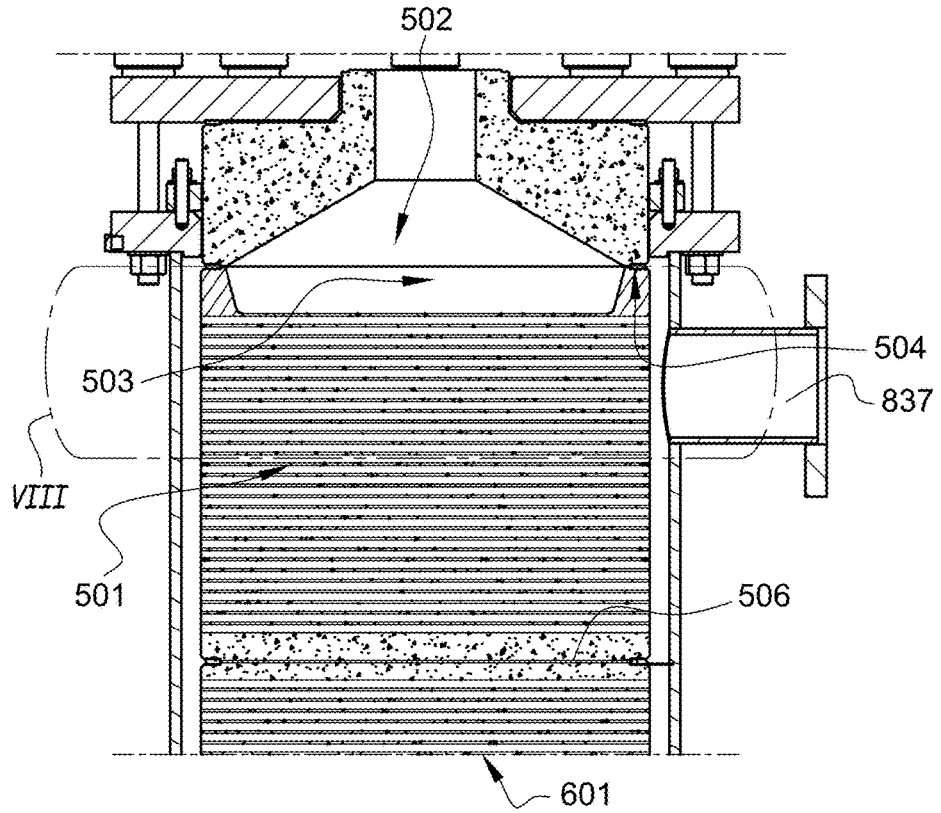
FIG. 7 is a longitudinal sectional view, analogous to FIG. 1, showing partly and at a greater scale a heat exchanger which is equipped with a block according to a second embodiment of the invention.
Figure 8:
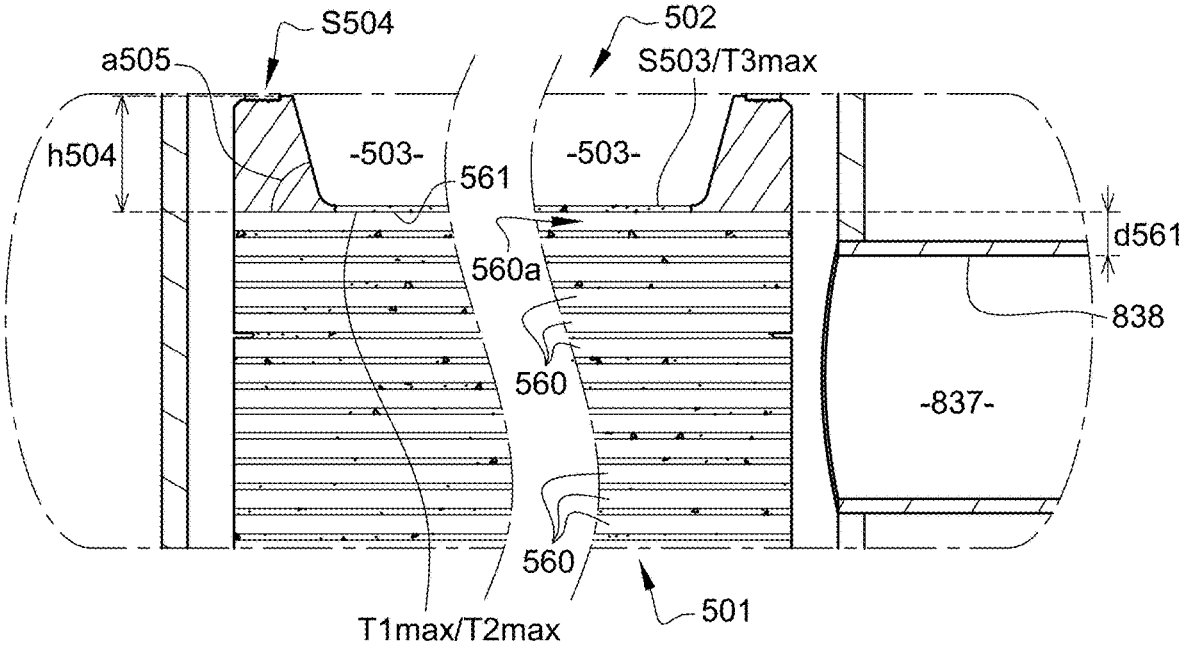
FIG. 8 is a longitudinal sectional view, similar to FIG. 3, illustrating in more detail zoom VIII of FIG. 7.
Figure 10:
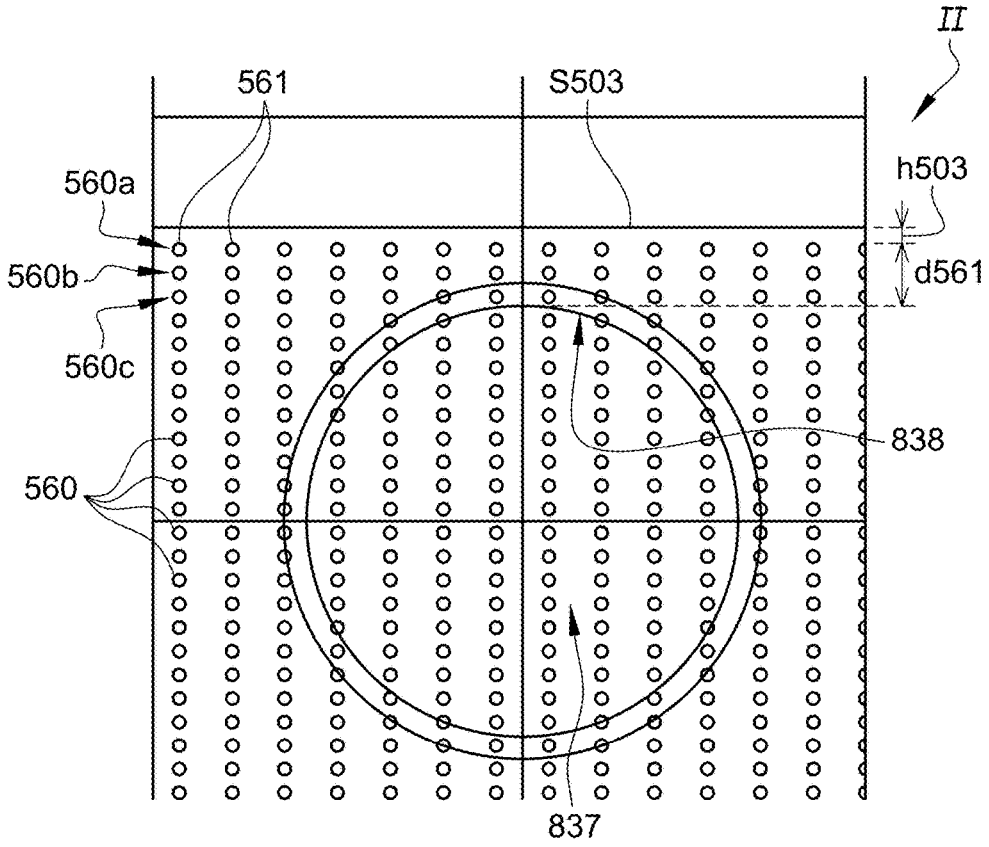

FIGS. 7, 8 and 10 illustrate a heat exchanger II and a block 501 according to a second embodiment of the invention. On these figures the mechanical elements, which are analogous to those of the first embodiment, are given the same references added by number 500, including space 824 and collar 826. FIG. 7 represents only the upstream block 501, according to the invention, as well as part of the adjacent block 601 which is conform to prior art.

Figure 9:
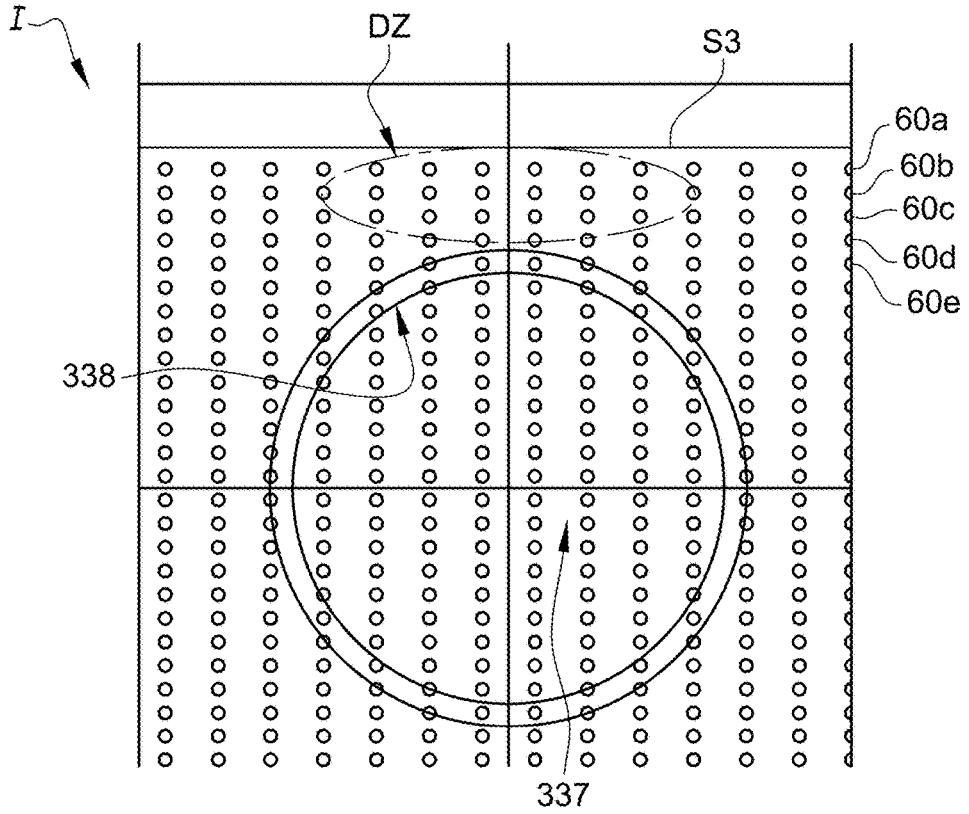
FIGS. 9 and 10 are schematic front views of the exchangers respectively of FIG. 1 and FIG. 7, showing in particular transverse channels of the blocks part of these exchangers, as well as the liquid flow in these channels.

Heat exchange block 501 of this second embodiment mainly differs from above described block 1, in that it is provided with a deeper bowl 503. In a more detailed manner, for a same global size of blocks, the upstream transverse channel 560*a* is positioned far below transverse channel 60*a*. In other words, block 501 is provided with less transverse channels with respect to block 1, in the upstream part of these blocks. Schematic FIG. 10, which illustrates block 501 with comparison to FIG. 9, shows that block 501 does not include any more the upper channels 60*a* and 60*b* of block 1.

Turning to FIG. 8, let us note 838 the wall of pipe 837, in contact with exhaust service fluid. This wall 838 is called superior, by convention, since it is turned towards the inlet of process fluid. According to this second embodiment, the distance d561 between upper wall 561 of channel 560*a* and above described superior wall 838 is advantageously inferior to 20 mm, in particular to 10 mm.

The invention encompasses a possibility, according to which upper wall 561 is located under superior wall 838 of the pipe. However this latest possibility is less preferred since it renders the manufacturing more complicated and it reduces heat transfer area, while bringing no further thermal effect.

The values of some other characteristic parameters of this second embodiment are analogous, with respect to the ones of above described first embodiment. Indeed h504 is analogous to h4, h503 is analogous to h3, ratio h504/503 is analogous to ratio h4/h3 and angle a505 is analogous to angle a5.

This second embodiment, provided with a so-called deep bowl 503, is more specifically adapted for cooling operation of the exchanger with high inlet temperature of process fluid, typically superior to 200° C. The applicant has discovered that, for these inlet values of process fluid temperature, a bowl such as the one 3 of first embodiment, does not ensure a completely satisfactory temperature homogenization.

The applicant has in particular discovered that service fluid flow has specific properties, in the very upstream part of block 1. On schematic FIG. 9, apart from line of upstream channels 60*a*, other adjacent lines of channels are noted 60*b* to 60*d*. In this case, the applicant has acknowledged that far less service fluid flows along these four lines of upper channels 60*a* to 60*d* of block 1 according to the first embodiment, bearing in mind that this number of lines may be different.

These upper lines of channels 60*a* to 60*d* therefore form a so-called dead zone, which is referenced DZ on FIG. 9. In this zone, as explained above, less service fluid flows, in addition at a very low speed. Due to the discovery of this phenomenon, the applicant has concluded that the risk of breaking the graphite in the very upstream part of block 1 is particularly high. Indeed, in this zone, substantial vaporization is likely to occur, which constitutes the main risk of graphite breaking.

As a consequence, digging a deeper bowl 503 permits an increased technical effect of temperature homogenization, while reducing the dead zone phenomenon, as above described. In this respect the specific advantages, linked to block 501 provided with a deep bowl according to this second embodiment, will be illustrated by the comparative example recited at the end of the present description.

It shall also be noted that, even though the manufacturing process of block 501 is less convenient than that of block 1, block 501 remains satisfactory for what concerns mechanical strength.

Figure 11:
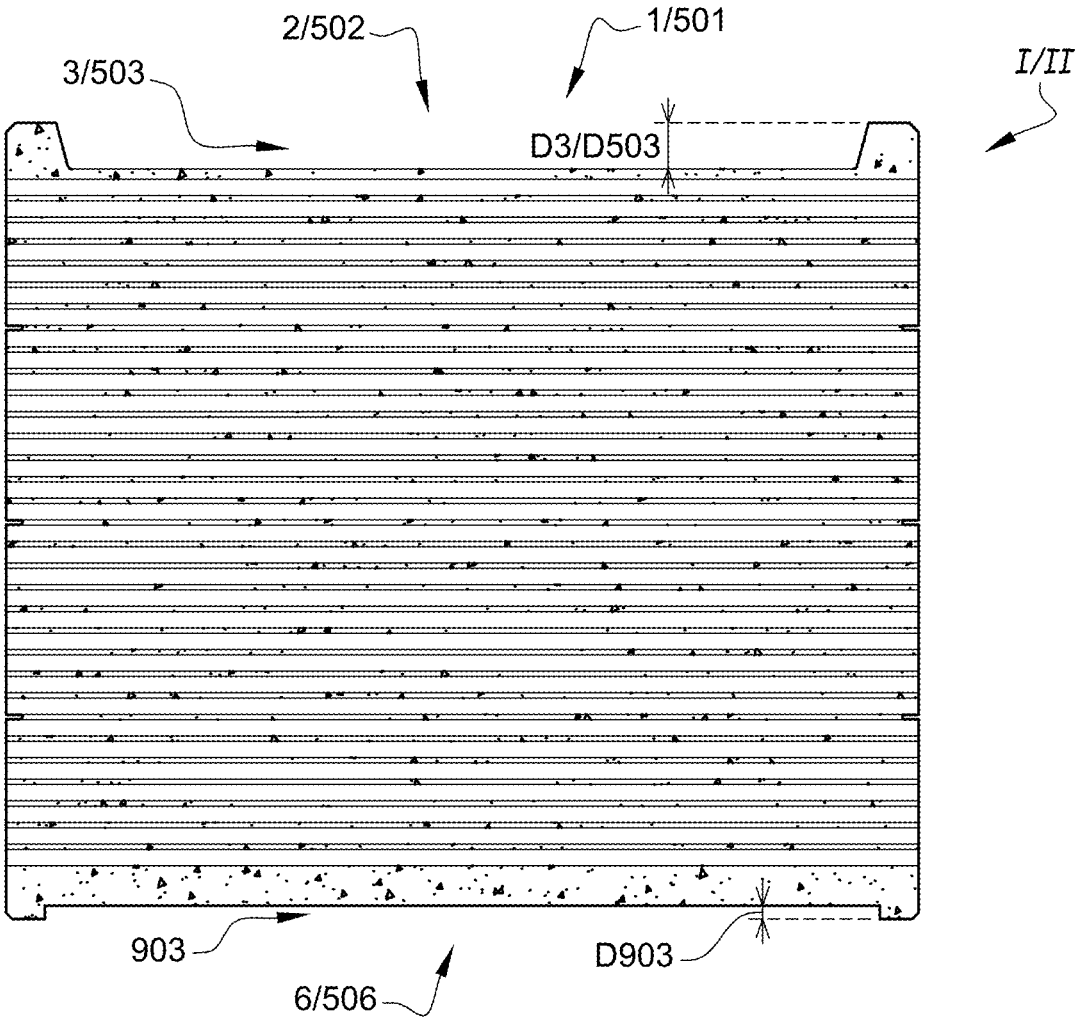
FIG. 11 is a schematic front view of a block, according to another variant of the invention.

FIG. 11 shows another variant of the invention, which can be applied either to block 1 or block 501. According to this variant, upstream front face 2/502 of block 1/501 is provided with a bowl 3/503 as above described. On the other hand downstream front face 6/506 of the block is provided with a chamber 903, typically according to prior art described in U.S. Pat. Nos. 3,391,016, 2,821,369 and GB-A-1 078 868. This chamber, which ensures only a function of fluid distribution between block 1/501 and adjacent not shown block, has a depth D903 which is far inferior to that D3/D503 of bowl. Typically the ratio between D3/D503 and D903 is superior to 1.3.

The two above embodiments of the invention, which are dedicated to cooling operations, refer to an exchanger I/II equipped with one single block 1/501 according to the invention. Said block, which is provided upstream with respect to the process fluid flow, is equipped with one single bowl 3/503 which is turned towards fluid process inlet. Indeed, in case of such a cooling, graphite temperature tends to decrease from the top surface S3 or S503 of the block towards the outlet of process fluid, in a substantial linear way. As a consequence the need for temperature homogenization is more particularly required at the upstream part of upstream block, which explains the provision of this single bowl As a variant, the exchanger may be equipped with an upstream so-called neutral block. In a way known as such, this neutral block does not ensure any exchange function, but an auxiliary function such as the fluid distribution. In this respect the single block according to the invention is positioned upstream, adjacent said neutral block.

Figure 12:
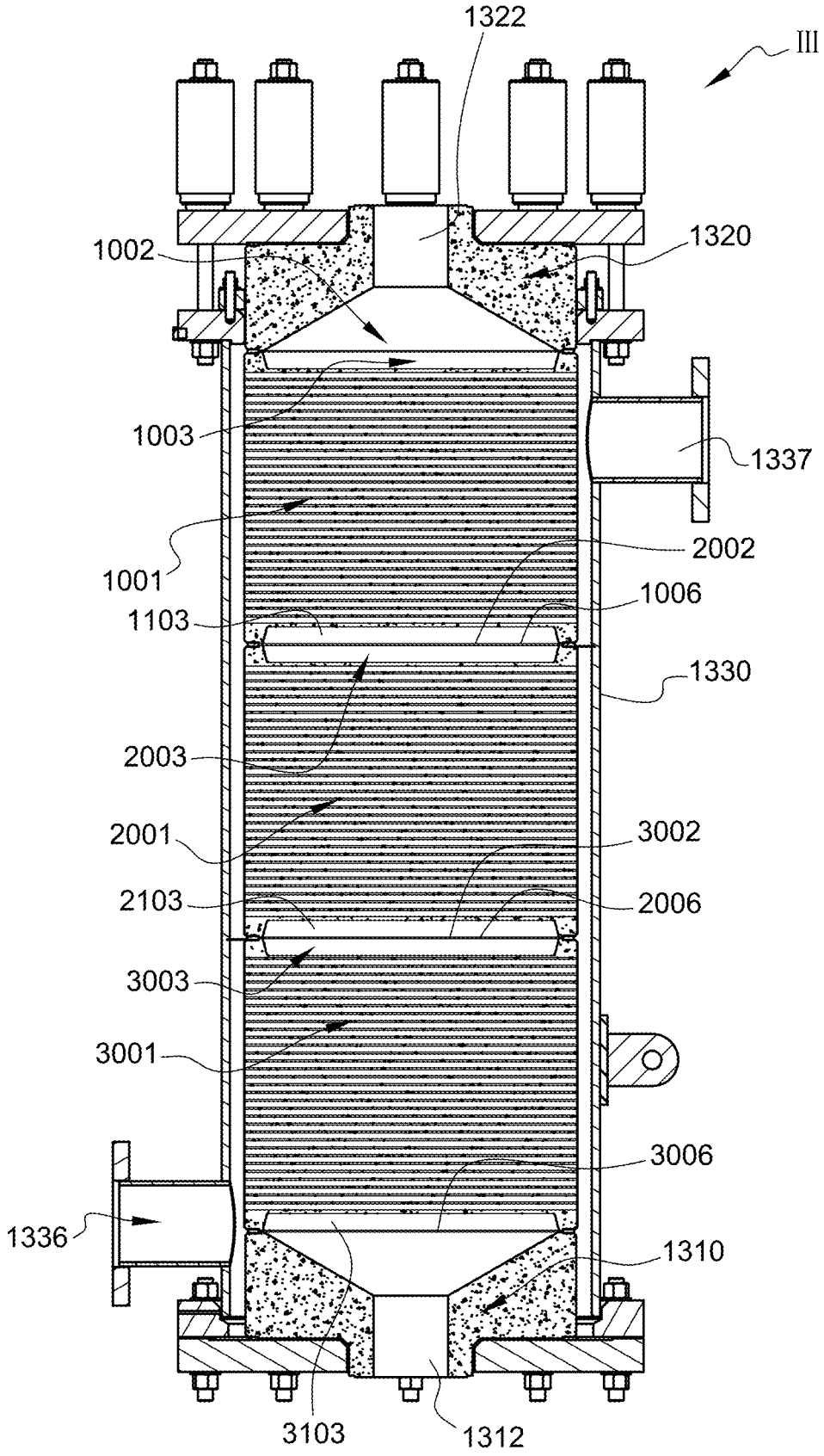
FIG. 12 is a longitudinal sectional view, analogous to FIG. 1, illustrating a heat exchanger which is equipped with a block according to a third embodiment of the invention.

FIG. 12 illustrates a heat exchanger III according to a third embodiment of the invention. On this figure the mechanical elements, which are analogous to those of the first embodiment, are given the same references added by number 1000, including space 1324 and collar 1326.

Heat exchanger III of this third embodiment mainly differs from above described exchangers I and II, essentially in that it is equipped with blocks 1001, 2001 and 3001 which are according to the invention. In addition, each of these blocks is provided with two temperature homogenization bowls, each located on a respective front face.

In a more detailed manner, upstream block 1001 is provided with an upstream bowl 1003 on its upstream front face 1002, as well as with a downstream bowl 1103 on its downstream front face 1006. Moreover intermediate block 2001 is provided with an upstream bowl 2003 on its upstream front face 2002, as well as with a downstream bowl 2103 on its downstream front face 2006. Finally downstream block 3001 is provided with an upstream bowl 3003 on its upstream front face 3002, as well as with a downstream bowl 3103 on its downstream front face 3006.

In a typical manner, above mentioned bowls 1003, 1103, 2003, 2103, 3003 and 3103 have the same depths, which advantageously corresponds to the depth of bowl 3 of first embodiment. In particular, it is less preferred to provide deep bowls, such as the one 503 of second embodiment. FIG. 12 illustrates three exchange blocks the one on top of the other, bearing in mind that this number may be different.

The exchanger III of this embodiment is more particularly adapted for a condensation operation, which corresponds to a biphasic flow of process fluid. In this respect, said process fluid is a gas submitted to a condensation, which may be complete or partial. By way of example, the inlet temperature of process fluid is between +80° C. and +300° C., whereas its outlet temperature is between −15° C. and +60° C. Moreover the inlet temperature of service fluid is between −20° C. and +35° C., whereas its outlet temperature is between −15° C. and +45° C.

Figure 13:
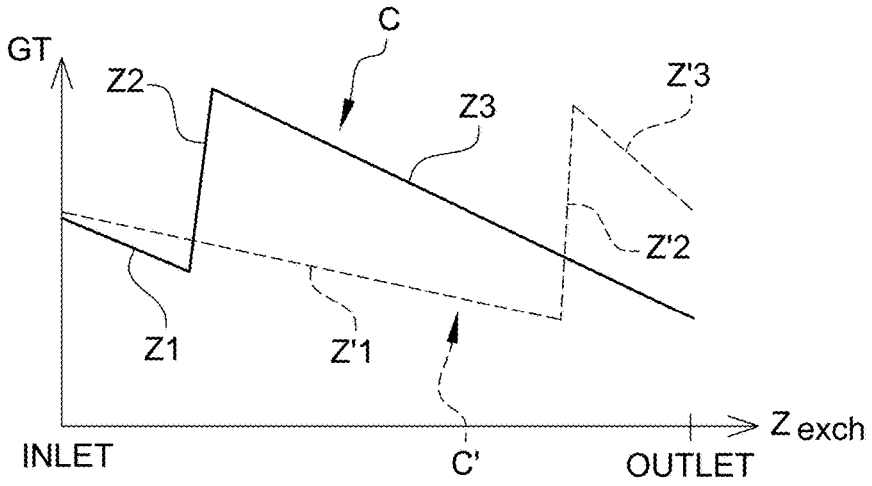
FIG. 13 is a graph, schematically showing in two different cases the evolution of graphite temperature, along the main dimension of a heat exchanger of prior art.

With reference to FIG. 13, in case of a condensation, the variation of graphite temperature throughout the exchanger is far different from the variation in case of a cooling operation. FIG. 13 gathers two curves C, C' which illustrate this graphite temperature GT, along the main dimension Zexch of the exchanger. In a first zone Z1, Z'1 close to the inlet, the temperature slowly decreases like in cooling operation, but then significantly increases when the condensation occurs, which corresponds to the zone Z2, Z'2. Finally this temperature turns back to a progressive decrease, in zone Z3, Z'3 close to the outlet.

Moreover the location of the zone Z2, Z'2 may vary along the exchanger, depending upon several parameters which may be the type of fluids, but also the operative conditions. In this respect, the solid line curve of FIG. 13 illustrates a zone Z2, which is close to the process fluid inlet. On the contrary, on this same FIG. 13, the dotted line curve shows a zone Z'2 which is in the vicinity of process fluid outlet.

As a consequence the need for temperature homogenization, in the present case of condensation, is required throughout the whole exchanger, and not only in its upstream part like for cooling operation. This acknowledgement, by the applicant, explains the advantageous provision of bowls not only on all blocks, but also on each front face of these blocks.

Figure 14:
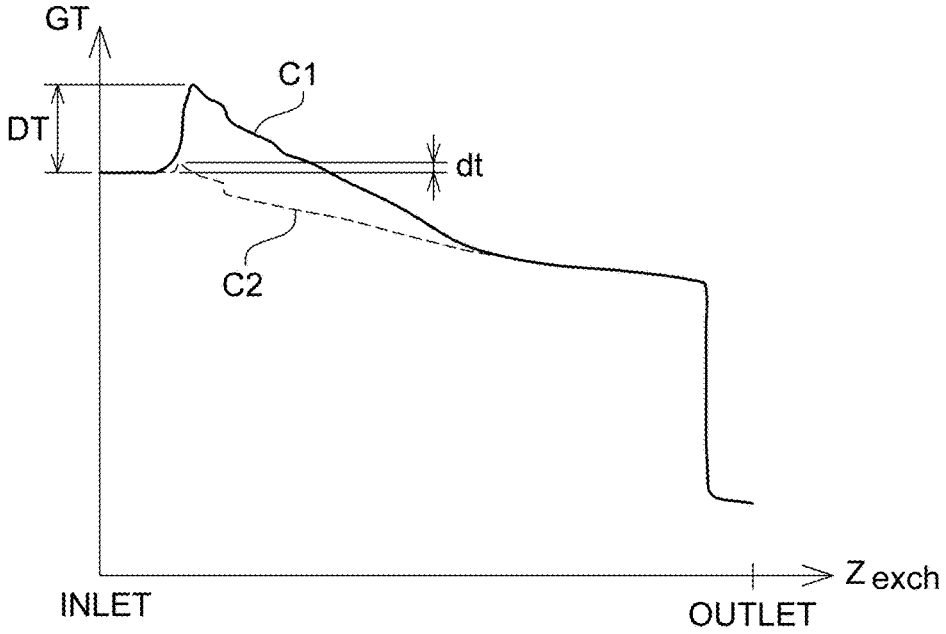
FIG. 14 is a graph, schematically showing the evolution of said graphite temperature, respectively with a prior art exchanger and with the exchanger of FIG. 12.

FIG. 14 illustrates a modelling of the technical effect brought about by the invention in case of a condensation. The solid line curve shows the variation of graphite temperature GT along the main dimension Zexch of the exchanger, in case of a prior art exchanger which is not provided with a bowl. On the other hand, the dotted line curve shows the same temperature variation for the same spots of the exchanger, in case of the exchanger III provided with a plurality of bowls.

It can be noted that the gas condensation provokes a significant temperature increase DT, which is likely to break or at least weaken the graphite in prior art. On the contrary, due to the invention, the temperature barely increases in the zone dt, which is favorable to the mechanical integrity of the exchanger. In addition the two above commented curves are mixed in the very upstream part of the exchanger, as well as in its downstream part.

In the embodiment of FIG. 12, all blocks are provided with opposite bowls. In theory, the invention may encompass variants wherein at least one block is provided with one single bowl, or even with no bowl at all. This variant may be suitable, in certain cases where the location of condensation can be precisely identified. However such a variant is far less preferred, since it does not ensure the temperature homogenization in each region of the exchanger.

Finally, in the three main embodiments of the invention, the exchanger extends vertically with a top inlet of process fluid, as well as a bottom outlet of said process fluid. Alternatively said process fluid may flow from the bottom to the top. As another variant, the exchanger may extend horizontally or in an oblique manner.

As a summary, the invention is based on the identification of the function of the bowl, which makes it possible to homogenize the graphite temperature over at least part of the exchanger. Moreover, depending upon the different applications, several embodiments may be considered, as it has been above detailed. In case of a cooling, one single bowl is preferred, in particular with a deep bowl if admission temperature of process fluid is high. In case of condensation, a plurality of bowls are preferred on every front face of every block.

It is to be noted that the bowl(s), provided in the front face(s) of the block(s) according to the invention, is (are) different from the chambers provided in the blocks disclosed in the above discussed U.S. Pat. Nos. 3,391,016, 2,821,369 and GB-A-1 078 868. Indeed, in these prior arrangements, said chambers only ensure a function of fluid distribution between two adjacent blocks. On the other hand, due to their very low depth, these chambers are not adapted to fulfil a significant function of temperature homogenization. In any case, these documents are not concerned with this homogenization function

Comparative Example

The following example illustrates the advantages and the technical effects brought about by the features according to the two main embodiments of the invention.

First a heat exchange block 401 was provided, according to prior art. With reference to FIG. 4, the features and the dimensions of this block are the following:

global height: 482 mm
global diameter: 602 mm
number of process channels: 295
diameter of each process channel: 16 mm
number of service channels: 464
diameter of each service channel: 10 mm
distance h460: 5 mm
distance h402: 26 mm.

Ten blocks according to prior art were accommodated the one on top of the other, in an enclosure analogous to the one of FIG. 1, so as to form a heat exchanger.

Secondly a block 1 was provided, according to the first embodiment of the invention. This block 1 differs from the one 401 according to prior art, essentially in that distance h4 (see FIG. 5) is 24.4 mm distance h3 (see also FIG. 5) is 5 mm.

This block 1 was accommodated in an enclosure with other blocks according to prior art, which are similar to the one 401.

Thirdly a block 501 was provided, according to the second embodiment of the invention. This block 501 differs from the one 1 according to the first embodiment of the invention, essentially in that distance h504 (see FIG. 8) is 54.4 mm distance h503 (see FIG. 8) is 5 mm it is provided with less transverse service channels 560. Indeed this block 501 is not provided with the two upper transverse channels 60*a* to 60*b* of block 1.

This block 501 was accommodated in an enclosure with other blocks according to prior art, which are similar to the one 401.

The three heat exchangers IV, I and II, equipped with respectively the above blocks 401, 1 and 501 as upstream blocks, were submitted to the same implementation methods. For each exchanger gaseous chloric acid HCl was fed in the process channels at a flow rate of 3142.8 kg/h, at a temperature of 1335° C. and at a pressure of 3.20 barg. At the same time a service fluid, typically water, was fed in the service channels 460 at a flow rate of 87000 kg/h, at a temperature of 63.6° C. and at a pressure of 4.25 barg.

During these implementations, for each exchanger several parameters were measured and put into the following table:

T1max which is the maximal temperature of water flowing into the fluid channels. The location of T1max, referenced on FIG. 8, corresponds to the upper edge of channel 560*a*, close to wall 561.

T2max which is the maximal temperature of graphite skin of the exchangers. The location of T2max, referenced on FIG. 8, corresponds to the graphite wall 561.

T3max which is the maximal temperature of graphite skin of the exchangers. The location of T3max, referenced on FIG. 8, corresponds to the graphite surface S503.

| Type of exchanger | IV | I | II |
|---|---|---|---|
| T1max | 164.6 | 137.2 | 112.0 |
| T2max | 203.6 | 168.8 | 138.4 |
| T3max | 340.3 | 233.7 | 216.0 |
| Heat exchanged (kW) | 781.4 | 780.3 | 770.3 |

As shown by the different simulation values, the invention makes it possible to substantially lower different characteristic temperatures of the implementation, with respect to prior art. In particular exchanger II and block 501, according to second embodiment of the invention, bring about a further lowering of these temperatures with respect to exchanger I and block 1, according to first embodiment.

This comparative example clearly shows the advantages of the invention, for what concerns thermal issues. Moreover, as explained above, this thermal technical effect does not lead to a significant mechanical weakening of the exchangers according to the invention.

The invention claimed is:

1. A heat exchange block, comprising:

a body formed of graphite and having a cylindrical shape with a circular cross-section;

longitudinal channels formed in the body along a longitudinal direction of the heat exchange block for flow of a process fluid, each longitudinal channel in the longitudinal channels continuously extending between two opposite front faces while opening onto the front faces; and transverse channels formed in the body along a transverse direction of the heat exchange block for flow of a service fluid, each transverse channel in the longitudinal channels continuously extending between two opposite transverse faces while opening onto said transverse faces, wherein at least one front face includes a recess so that the at least one front face delimits:

a central homogenization bowl operable to homogenize a temperature of the constitutive material of the heat exchange block, the central homogenization bowl defining a central reference surface, a peripheral seat operable to receive a sealing mechanism, the peripheral seat protruding upstream with respect to the central homogenization central bowl along the longitudinal direction, the peripheral seat defining a peripheral reference surface, a transition portion which extends between the peripheral seat and the central homogenization bowl, and a peripheral distance between the peripheral reference surface and a facing wall of a closest transverse channel in the transverse channels, the peripheral distance being greater to a central distance between the central reference surface and the facing wall of a closest transverse channel in the transverse channels, the peripheral distance and the central distance being considered along the longitudinal direction of the block, wherein a ratio between the peripheral distance and the central distance is greater than 2.

2. The heat exchange block of claim 1, wherein the peripheral distance is greater than two times a diameter of the closest transverse channel in the transverse channels.

3. The heat exchange block of claim 1, wherein the central distance is greater than two times a smallest material thickness between the longitudinal channels and the transverse channels.

4. The heat exchange block of claim 1, wherein a transition angle between a transition portion reference surface of the transition portion and the central reference surface of the central homogenization bowl is between 30° and 90°.

5. The heat exchange block of claim 1, wherein:

only an upstream front face of the front faces is provided with the central homogenization bowl, and an opposite downstream front face of the front faces is flush or is provided with a fluid distribution chamber having a depth that is less than a depth central homogenization bowl.

6. The heat exchange block of claim 1, wherein an upstream front face of the front faces is provided with an upstream central homogenization bowl and an opposite downstream front face of the front faces is provided with a downstream central homogenization bowl.

7. A heat exchanger, comprising:

an enclosure having a lower cover, an upper cover, and a peripheral casing; and at least one heat exchange block arranged between the lower cover and the upper cover, each heat exchange block including:

a body formed of graphite and having a cylindrical shape with a circular cross-section, longitudinal channels formed in the body along a longitudinal direction of the heat exchange block for flow of a process fluid, each longitudinal channel in the longitudinal channels continuously extending between two opposite front faces while opening onto the front faces, and transverse channels formed in the body along a transverse direction of the heat exchange block for flow of a service fluid, each transverse channel in the longitudinal channels continuously extending between two opposite transverse faces while opening onto said transverse faces, a first inlet for flow of the process fluid into the longitudinal channels;

a second inlet for flow of the service fluid into the transverse channels;

a first outlet for flow of the process fluid from the longitudinal channels;

second outlet for flow of the service fluid from the transverse channels, wherein at least one front face includes a recess so that the at least one front face delimits:

a central homogenization bowl operable to homogenize a temperature of the constitutive material of the heat exchange block, the central homogenization bowl defining a central reference surface, a peripheral seat operable to receive a sealing mechanism, the peripheral seat protruding upstream with respect to the central homogenization central bowl along the longitudinal direction, the peripheral seat defining a peripheral reference surface, a transition portion which extends between the peripheral seat and the central homogenization bowl, and a peripheral distance between the peripheral reference surface and a facing wall of a most adjacent transverse channel in the transverse channels, the peripheral distance being greater to a central distance between the central reference surface and the facing wall of a closest transverse channel in the transverse channels, the peripheral distance and the central distance being considered along the longitudinal direction of the block, wherein a ratio between the peripheral distance and the central distance is greater than 2.

8. The heat exchanger of claim 7, wherein a first heat exchange block in the at least one heat exchange block is located upstream adjacent to the first inlet.

9. The heat exchanger of claim 8, wherein the first heat exchange block includes an upstream central homogenization bowl located on an upstream front face of the front faces that is turned towards the first inlet.

10. The heat exchanger of claim 7, wherein a distance along a longitudinal direction of the at least one heat exchange block between a facing wall of a most adjacent one of the transverse channels and an upper wall of the second outlet is less than 10 mm.

11. The heat exchanger of claim 10, wherein the facing wall, when compared to the upper wall, is arranged most adjacent to the first inlet.

12. The heat exchanger of claim 7, wherein an upstream front face of the front faces is provided with an upstream central homogenization bowl and an opposite downstream front face of the front faces is provided with a downstream central homogenization bowl.

13. The heat exchanger of claim 7, wherein the peripheral distance is greater than two times a diameter of the closest transverse channel in the transverse channels.

14. The heat exchanger of claim 7, wherein the central distance is greater than two times a smallest material thickness between the longitudinal channels and the transverse channels.

15. The heat exchanger of claim 7, wherein a transition angle between a transition portion reference surface of the transition portion and the central reference surface of the central homogenization bowl is between 30° and 90°.

16. The heat exchanger of claim 7, wherein only an upstream front face of the front faces is provided with the central homogenization bowl.

17. The heat exchanger of claim 14, wherein an opposite downstream front face of the front faces is flush or is provided with a fluid distribution chamber having a depth that is less than a depth central homogenization bowl.

18. A method of manufacturing method the heat exchanger block of claim 16, the method comprising:

providing the heat exchanger block with the longitudinal channels and the transverse channels; and removing material from the heat exchanger block to form the central homogenization bowl and the transition portion.

* * * * *